US005176972A

United States Patent [19]

Bloom et al.

[11] Patent Number: 5,176,972

[45] Date of Patent: Jan. 5, 1993

[54] IMAGING MEDIUM WITH LOW REFRACTIVE INDEX LAYER

[75] Inventors: Iris B. K. Bloom, Waltham; Richard A. Minns, Arlington; William T. Plummer, Concord, all of Mass.

[73] Assignee: Polaroid Corporation, Cambridge, Mass.

[21] Appl. No.: 757,910

[22] Filed: Sep. 11, 1991

[51] Int. Cl.[5] ..... G03C 5/54; G03C 1/80

[52] U.S. Cl. ..... 430/14; 430/215; 430/220; 430/227; 430/535; 430/950

[58] Field of Search ..... 430/220, 215, 950, 14, 430/227, 535

[56] References Cited

U.S. PATENT DOCUMENTS

| | | | |
|---|---|---|---|
| 2,481,770 | 9/1949 | Nadeau | 95/9 |
| 2,968,649 | 1/1961 | Pailthrop et al. | 260/80.5 |
| 2,983,606 | 5/1961 | Rogers | 96/29 |
| 3,345,163 | 10/1967 | Land et al. | 96/3 |
| 3,415,644 | 12/1968 | Land | 96/3 |
| 3,427,158 | 2/1969 | Carlson et al. | 96/3 |
| 3,594,165 | 7/1971 | Rogers | 96/3 |
| 3,647,437 | 3/1972 | Land | 96/3 |
| 3,706,557 | 12/1972 | Arond | 96/29 D |
| 3,719,489 | 3/1973 | Cieciuch et al. | 96/29 D |
| 3,793,022 | 2/1974 | Land et al. | 430/220 |
| 4,098,783 | 7/1978 | Cieciuch et al. | 260/147 |
| 4,298,674 | 11/1981 | Land et al. | 430/213 |
| 4,367,277 | 1/1983 | Chiklis et al. | 430/213 |
| 4,424,326 | 1/1984 | Land et al. | 526/265 |
| 4,499,164 | 2/1985 | Plummer | 430/14 |
| 4,740,448 | 4/1988 | Kliem | 430/214 |
| 4,794,067 | 12/1988 | Grasshoff et al. | 430/213 |

OTHER PUBLICATIONS

Granger and Cupery, Photog. Sci. Eng. 16(3), 221 (1972).

Kiron, Tech. Sheet No. 2.

Ohta, J. App. Photog. Eng., 2(2), 75 (1976).

Ohta, Photog. Sci. Eng., 16(5), 334 (1972).

Williams and Clapper, J. Opt. Soc. Am., 43(7), 595 (1953).

*Primary Examiner*—Richard L. Schilling

*Attorney, Agent, or Firm*—David J. Cole

[57] ABSTRACT

An imaging medium comprises means for providing a light-reflecting layer, an image-receiving layer for receiving image-forming components, a transparent layer superposed over the image-receiving layer such that an image in the image-receiving layer can be viewed through the transparent layer against the light-reflecting layer, and an image enhancement layer disposed between the image-receiving layer and the transparent layer, the image enhancement layer having a refractive index less than that of the transparent layer and the image-receiving layer and not greater than about 1.43. The image enhancement layer decreases internal reflections within the medium and thereby improves the quality of the image seen. The imaging medium can be used as the imaging element of a diffusion transfer process film unit.

29 Claims, 7 Drawing Sheets

IMAGING MEDIUM WITH LOW REFRACTIVE INDEX LAYER

BACKGROUND OF THE INVENTION

This invention relates to an imaging medium with a low refractive index layer. More specifically, it relates to such an imaging medium in which a low refractive index layer is interposed between an image-receiving layer and a transparent layer through which an image formed on the image-receiving layer is viewed.

Multi-layered imaging media in which an image is viewed against a light scattering background are known. Such media are generally structured as a series of thin layers overlying one another and typically include a transparent image-receiving layer or layers in which the image is formed by an imagewise and depthwise distribution of image forming components. One surface of the image-receiving layer is usually in contact with a light scattering layer against which the image is viewed. In some types of imaging media, for example the integral diffusion transfer process film units described in, inter alia. U.S. Pat. Nos. 3,415,644; 3,594,165; 3,647,437; 4,367,277 and 4,740,448, the other surface of the image-receiving layer is covered with a transparent layer, which protects the rather fragile image-receiving layer during handling of the exposed film unit; this transparent layer is typically a polymeric film which serves as a support for the imaging-receiving layer. The image is viewed through the transparent layer, and is thus illuminated by ambient light, which passes through the transparent layer and the image-receiving layer, after which the light is reflected from the light scattering layer and then in part is transmitted back through the image-receiving layer and transparent layer to the viewer.

In such an imaging medium, substantial amounts of light undergo total internal reflection at the transparent layer/air boundary, since the refractive index of the transparent layer in commercial imaging media is typically around 1.64. The effects of such internal reflection in color prints have been investigated theoretically by Williams and Clapper, Journal of the Optical Society of America, 43(7), 595 (1953). This paper shows that such internal reflection accounts for staining of highlights, increase in maximum density, shortened exposure latitude, and color desaturation. From the mathematical model in the Williams and Clapper paper, one can also infer that loss of sharpness will occur when the transparent layer is of significant thickness. Similar theoretical investigations may be found in N. Ohta, Photographic Science and Engineering, 16(5), 334 (1972), which states that "[C]olor reproduction characteristics may be considerably influenced by refractive index n of binders, especially when the color prints are viewed under diffuse illuminations.", and by the same author in Journal of Applied Photographic Engineering, 2(2), 75 (1976), which states that "Color reproduction in color prints is complicated due to the non-linear relationship between reflection density and dye amount. The nonlinearity arises from surface reflection, refraction and multiple internal reflections of light flux in a gelatin layer." This paper also discusses the effect of color gamut in color prints under diffuse illumination versus refractive index of the binder. However, although all three of the aforementioned papers discuss the deleterious effects of internal reflections on the quality of a print as seen by a viewer, they do not make any suggestions for modifying the structure of the print to reduce these deleterious effects.

U.S. Pat. No. 2,481,770 describes a photographic film, of the conventional negative-producing type, with a low refractive index layer between the emulsion and the support. This low refractive index layer is stated to reduce halation by lowering the effect of total internal reflection of light at the rear face of the support or a dye backing.

U.S. Pat. Nos. 3,427,158; 3,706,557 and 4,298,674 all describe film units of the integral diffusion transfer process type, in which the image-receiving element comprises an image-receiving layer, a spacer layer, a neutralizing layer and a transparent (support) layer. An alkaline developer is released between the image-receiving layer and the photosensitive element of the film unit to develop the image. Hydroxyl ions from this alkaline developer diffuse through the image-receiving layer and the spacer layer so that, after a predetermined period, the hydroxyl ions are neutralized by the acid in the neutralizing layer and development is terminated.

U.S. Pat. No. 4,367,277 describes a film unit of the integral diffusion transfer process type, in which the image-receiving element comprises an image-receiving layer, a transparent layer and an unhardened gelatin layer disposed between the image-receiving layer and an alkaline developer. The unhardened gelatin serves as a decolorizing layer which decolorizes the part of the developer immediately adjacent the image-receiving layer, so rendering the film unit white to a viewer looking through the transparent layer during development.

U.S. Pat. No. 4,499,164 describes an image-carrying medium comprising a transparent image-receiving layer, adjacent one surface of which is disposed a layer of image dye(s) which forms the image; a light-scattering pigment layer is disposed adjacent the image dye layer. An optical barrier layer is disposed between the image dye layer and the underlying diffuse reflector, this optical barrier layer operating to minimize non-linear density effects due to multiple internal reflections within the medium. The patent states that the use of a low refractive index material in the optical barrier layer is advantageous.

It has now been found that, in an imaging medium in which a transparent layer is superposed over the image-receiving layer so that the image in the image-receiving layer is viewed through the transparent layer against a background provided by a light-reflecting layer, the deleterious effects on perceived image quality caused by internal reflection can be reduced by placing a layer of low refractive index between the image-receiving layer and the transparent layer. It has also been found that prints from certain integral diffusion transfer process film units, in which such an imaging medium is employed as the image-receiving element, display improved aging properties.

SUMMARY OF THE INVENTION

Accordingly, this invention provides an imaging medium comprising:

means for providing a light-reflecting layer;

an image-receiving layer for receiving image-forming components;

a transparent layer superposed over the image-receiving layer on the opposed side thereof from the means for providing a light-reflecting layer such that an image in the image-receiving layer can be viewed through the transparent layer against the light-reflecting layer provided by said means; and an image enhancement layer disposed between the image-receiving layer and the transparent layer, the image enhancement layer having a refractive index less than the refractive indices of the image-receiving layer and the transparent layer, and not greater than about 1.43.

This invention also provides an imaging medium comprising:

means for providing a light-reflecting layer;

an image-receiving layer for receiving image-forming components, the image-receiving layer having a refractive index of at least about 1.45;

a transparent layer superposed over the image-receiving layer on the opposed side thereof from the means for providing a light-reflecting layer such that an image in the image-receiving layer can be viewed through the transparent layer against the light-reflecting layer provided by said means, the transparent layer having a refractive index of at least about 1.50; and an image enhancement layer disposed between the image-receiving layer and the transparent layer, the image enhancement layer having a refractive index not greater than about 1.43.

This invention also provides a diffusion transfer process film unit comprising first and second sheet-like elements and a rupturable pod of processing composition, the film unit having means for providing a light-reflecting layer:

the first sheet-like element comprising photosensitive and image-forming components;

the rupturable pod of processing composition being positioned to release the processing composition across the film unit between the first and second sheet-like elements and in contact with the photosensitive and image-forming components upon rupture of the pod, thereby releasing image-forming components from the first sheet-like element:

the second sheet-like element comprising an image-receiving layer for receiving image-forming components: a transparent layer superposed over the image-receiving layer on the opposed side thereof from the means for providing a light-reflecting layer such that an image in the image-receiving layer can be viewed through the transparent layer against the light-reflecting layer provided by said means; and an image enhancement layer disposed between the image-receiving layer and the transparent layer, the image enhancement layer having a refractive index less than the refractive indices of the image-receiving layer and the transparent layer, and not greater than about 1.43.

DETAILED DESCRIPTION OF THE INVENTION

Figure 1:
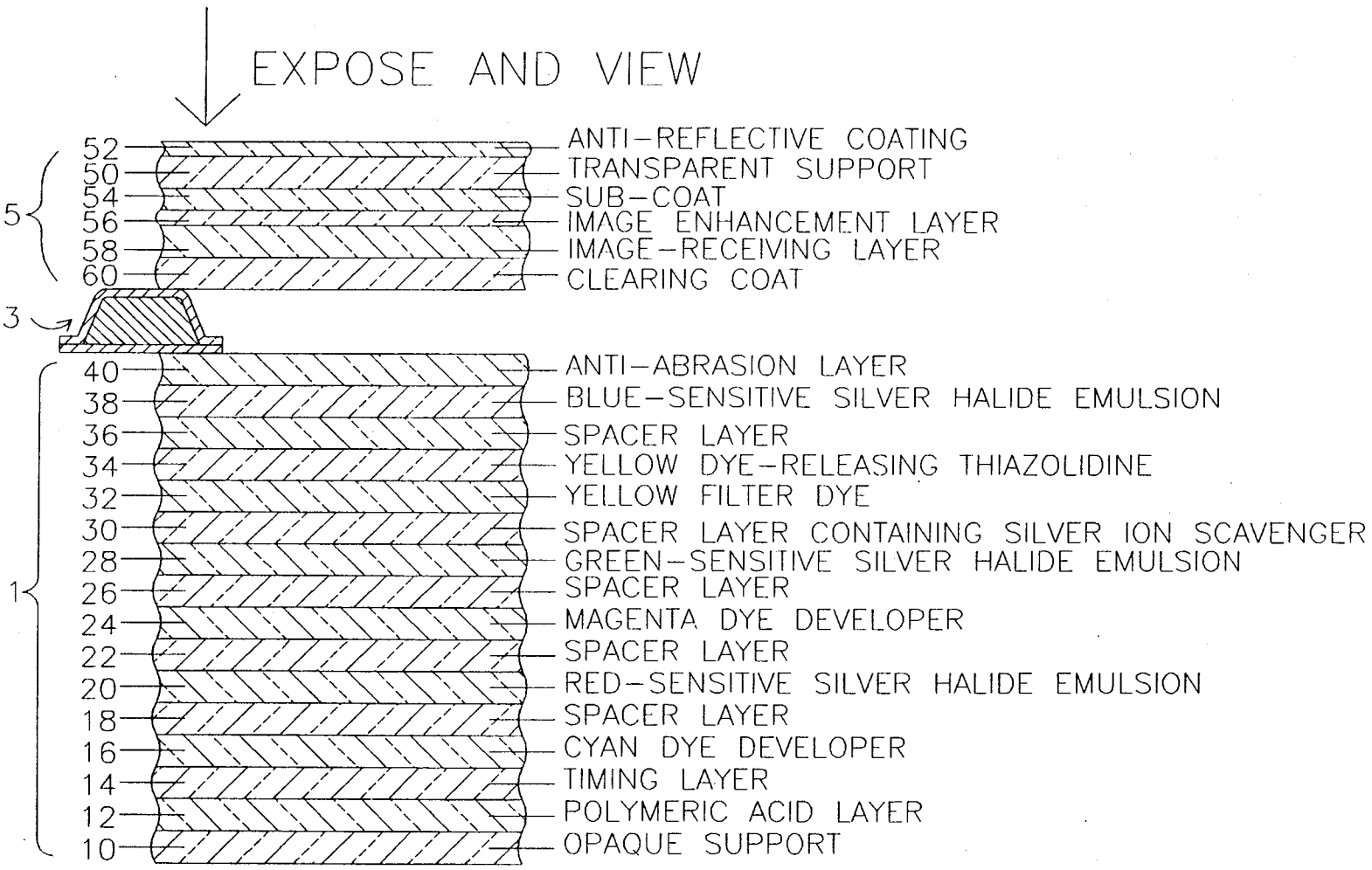
FIG. 1 of the accompanying drawings is a schematic section through a diffusion transfer process film unit of the present invention.

The image-forming component in the film unit of the present invention may be any material which when contacted with an appropriate image-receiving layer produces a change in the transmission and/or reflectance characteristics of the receiving sheet under electromagnetic radiation. Thus, in addition to dyes which are inherently colored compounds as perceived by the human eye, the term image-forming component may be (a) a material which changes only the transmission and/or reflectance characteristics of the image-receiving layer in non-visible electromagnetic radiation (for example, "invisible inks" which fluoresce in the visible region upon exposure to ultraviolet radiation); (b) a material which only develops color when contacted with another material; (c) a material which produces a visually discernible color shift from colorless to colored, from colored to colorless, or from one color to another, upon contact with an appropriate image-receiving layer.

The term "image" is used herein to refer to any arrangement on the image-receiving layer of areas which exhibit differing transmission and/or reflectance characteristics under electromagnetic radiation. Thus, the term "image" is used herein to include not only graphic or pictorial images but also textual material and quasi-textual material for machine "reading", for example, bar codes.

The present invention extends to the imaging medium of the invention in both its unexposed form and its exposed and developed form (in which the image-receiving layer bears an image).

The means for providing a light-reflecting layer in the imaging medium of the present invention may be a preformed light-reflecting layer (as described, for example, in the aforementioned U.S. Pat. No. 3,594,165), or may be some component of the imaging medium which does not form a light-reflecting layer in the unexposed medium but does provide such a layer in the final exposed and developed medium. For example, as described in the aforementioned U.S. Pat. No. 4,740,448, the means for providing a light-reflecting layer in a diffusion transfer process film unit may be a white pigment in a processing composition which is spread between the first, image-forming component and the second, image-receiving component of the film unit.

As already mentioned, in the imaging medium of the present invention, an image enhancement layer of low refractive index is interposed between the image-receiving layer and the transparent layer to reduce the effects of internal reflections within the imaging medium. The image enhancement layer desirably has a refractive index not greater than about 1.40, preferably not greater than about 1.38. Indeed, as will be shown in more detail below, the improvement in image quality provided by the image enhancement layer increases as the refractive index of that layer decreases, and thus the refractive index of the image enhancement layer is desirably kept as low as possible. Fluorinated polymers are available having refractive indices within the range of from about 1.29 to about 1.38. One commercial fluorinated polymer, Teflon AF, sold by DuPont de Nemours, Wilmington, Del., can have a refractive index as low as 1.29.

The refractive index of the image enhancement layer is lower than that of most polymers conventionally used in diffusion transfer process film units (although some anti-reflection layers may have low refractive indices), and in particular is substantially lower than those of the polymers conventionally used as the spacer and neutralizing layers in the aforementioned U.S. Pat. Nos. 3,427,158; 3,706,557 and 4,298,674.

Various types of fluorocarbon polymers can be used to form the image enhancement layer. For example, this layer may be formed from a fluorinated acrylate polymer. Among the fluorinated acrylate monomers which may be used to form appropriate polymers are those of the formula:

$$CH_2{=}CH{-}CO{-}O(CH_2)_n{-}Y{-}T$$

where n = 1 or 2, Y is a perfluoroalkylene grouping and T is fluorine or a $-CF_2H$ group, for example 1H,1H-pentadecafluorooctyl acrylate. The fluorinated monofunctional acrylate monomer may also contain heteroatoms such as sulfur, oxygen and nitrogen; examples of such monomers are those of the formula:

$$Z{-}SO_2{-}NR{-}CH_2{-}CH_2{-}O{-}CO{-}CA{=}CH_2$$

where Z is $H(CF_2)_m$ or $F(CF_2)_m$, where m is an integer from 3 to 12, R is an alkyl group and A is hydrogen or methyl. Examples of commercially available acrylate monomers which could be used in the present invention are (the figures in parentheses are the refractive index of the homopolymers) 1H,1H,5H-octafluoropentyl acrylate (1.380), trifluoroethyl acrylate (1.407), and heptafluorobutyl acrylate (1.367), all of which are available from PCR Incorporated, P.0. Box 1466, Gainesville, Fla. 32602,

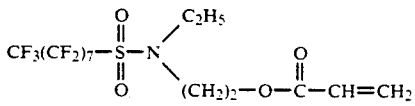

which is available from Minnesota Mining and Manufacturing Company, St. Paul, Minn. under the tradename FX-13, and:

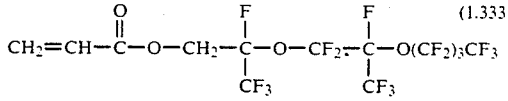

(1.333)

which is available from the same supplier under the tradename L-9911.

However, it is generally desirable to form the image enhancement layer from a fluorolefin polymer, preferably a copolymer of vinylidene fluoride and hexafluoropropylene, a terpolymer of vinylidene fluoride, hexafluoropropylene and tetrafluoroethylene, or a blend of such a copolymer or terpolymer with polytetrafluoroethylene (PTFE). Vinylidene fluoride/hexafluoropropylene copolymers and vinylidene fluoride/hexafluoropropylene/ tetrafluoroethylene terpolymers are available commercially from Minnesota Mining and Manufacturing Company, St. Paul, Minn., under the trademark Fluorel. In general, in these Fluorel polymers, the weight ratio of vinylidene fluoride to hexafluoropropylene is in the range of from 2.33:1 to 0.67:1, while the terpolymers generally contain from 3 to 35 percent by weight of tetrafluoroethylene and from 97 to 65 percent by weight of vinylidene fluoride and hexafluoropropylene.

These polymers can be prepared by the copolymerization in known manner of a mixture of the corresponding monomers. An aqueous redox polymerization system can be used and polymerization can be initiated by resort to a conventional ammonium persulfate/-sodium bisulfite system. Polymerization will normally be accomplished under pressure at moderately elevated temperatures. Suitable methods for the production of the polymers are known and are described in greater detail in U.S. Pat. No. 2,968,649.

A specific preferred copolymer is that sold as Fluorel FC-2175. This material is stated by the manufacturer to be of the formula:

$$\left(CF_2CF(CF_3)\right)_n\left(CH_2CF_2\right)_m$$

where m/n is approximately 4. The material has a refractive index of 1.370 and a glass transition temperature of −22° C.

Commercial forms of fluoropolymers may contain minor components produced as by-products during the synthesis of the polymers, or suited to a particular purpose but which may contribute to cloudiness and which are unsuitable for optical applications. These materials can, however, be filtered prior to use for removal of such components. It has been found that filtering a 5 percent solution of Fluorel FC-2175 in acetone under low pressure through diatomaceous earth, or filtering a 25 percent solution of Fluorel FC-2175 in acetone through a 0.2 μ pleated nylon membrane, followed by evaporation of the acetone, gives a clarified product suitable for use in the present invention.

When PTFE is employed as part of the image enhancement layer, the PTFE is desirably used in the form of a latex having an average particle size below about 1 μ. One suitable latex is that sold under the registered trademark Hostaflon TF-5032 by Hoechst-Celanese, Route 202-206 North, Somerville N.J. 08876.

This latex has an average particle size of about 0.2 μ. Blends of 70 to 90 percent by weight PTFE with 30 to 10 percent by weight copolymer or terpolymer are recommended for use in the present invention.

The image enhancement layer desirably has a thickness in the range of about 0.5 to 5 μ, preferably about 0.8 to about 2 μ. The image enhancement layer should have a thickness of at least about one wavelength of the light in which the image is illuminated in order to perform its optical function properly, and in practice a thickness of approximately 1.2 μ (corresponding to a coating weight of about 200 mg/ft$^2$. for the preferred fluoroolefin polymers, which have a specific gravity of about 1.8) is recommended to avoid excessive consumption of polymer while allowing for inevitable variations in the thickness of the layer produced during coating.

The materials used to form the image-receiving layer and the transparent layer of the present imaging medium can be the same as those in prior art media of the same type, and such materials will be familiar to those skilled in imaging media technology. Further details of appropriate materials are given in the aforementioned U.S. Pat. Nos. 3,427,158; 3,594,165; 3,706,557; 4,298,674 and 4,740,448. Thus, for instance, the image-receiving layer may be formed from gelatin or a polymer. A polyester, polyacrylate, polycarbonate, poly(vinyl acetate), styrene-acrylate copolymer, polyurethane, polyamide, polyurea, poly(vinyl chloride) or polyacrylonitrile resin may be used as the image receiving layer. Preferably, the image-receiving layer is as described in U.S. Pat. No. 4,794,067 and comprises a quaternary ammonium copolymeric mordant of the formula:

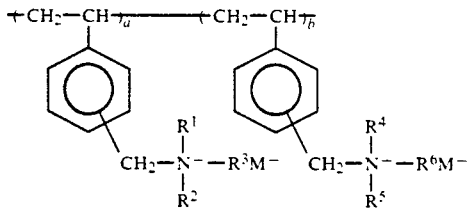

(wherein each of $R^1$, $R^2$ and $R^3$ is independently alkyl of from 1 to 4 carbon atoms: each of $R^4$, $R^5$ and $R^6$ is independently alkyl of from 1 to 18 carbon atoms and the total number of carbon atoms in $R^4$, $R^5$ and $R^6$ is from 13 to 20; each $M^-$ is an anion; and each of a and b is the molar proportion of each of the respective repeating units), or a similar terpolymer of the formula:

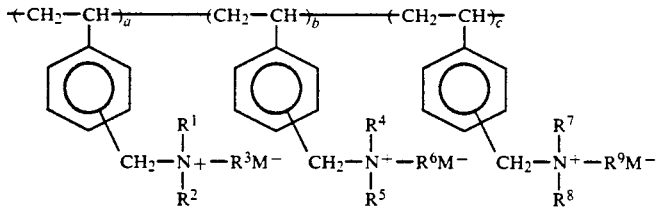

(wherein each of $R^1$, $R^2$, $R^3$, $R^4$, $R^5$ and $R^6$ is independently alkyl of from 1 to 4 carbon atoms; each of $R^7$, $R^8$ and $R^9$ is independently alkyl of from 1 to 18 carbon atoms and the total number of carbon atoms in $R^7$, $R^8$ and $R^9$ is from 13 to 20; each $M^-$ is an anion; and each of a, b and c is the molar proportion of each of the respective repeating units); in a specific preferred terpolymer of this type, each of $R^1$, $R^2$, $R^3$, $R^7$ and $R^8$ is a methyl group; each of $R^4$, $R^5$ and $R^6$ is an ethyl group; and $R^9$ is an n-$C_{18}H_{37}$ group.

The image receiving layer desirably also comprises a hydrophilic polymer (for example, gelatin, poly(vinyl alcohol), polyvinylpyrrolidone or a mixture thereof), which acts as a permeator to vary the permeability of the image receiving layer. A specific material of this type which has been found to give good results in the present process comprises a mixture of approximately equal weights of a copolymer, of the first of the two aforementioned formulae, in which $R^1$, $R^2$, $R^3$, $R^4$ and $R^5$ are all methyl groups and $R^6$ is a dodecyl group, with poly(vinyl alcohol). The thickness of the image receiving layer will typically be around 3 μ, and its refractive index is normally in the range of about 1.50 to about 1.60.

In diffusion transfer process film units of the present invention the image-forming component may be a complete dye or a dye intermediate, e.g., a color coupler. Preferred embodiments of this invention use a dye developer, that is, a compound which is both a silver halide developing agent and a dye disclosed in U.S. Pat. No. 2,983,606. As is now well known, the dye developer is immobilized or precipitated in developed areas as a consequence of the development of the latent image. In unexposed and partially exposed areas of the emulsion, the dye developer is unreacted and diffusible and thus provides an imagewise distribution of unoxidized dye developer, diffusible in the processing composition, as a function of the point-to-point degree of exposure of the silver halide emulsion. At least part of this imagewise distribution of unoxidized dye developer is transferred, by imbibition, to a superposed image-receiving layer to provide a reversed or positive color image of the developed image. The image-receiving layer preferably contains a mordant for transferred unoxidized dye developer. As disclosed in the aforementioned U.S. Pat. Nos. 2,983,606 and 3,415,644, the image-receiving layer need not be separated from its superposed contact with the photosensitive element, subsequent to transfer image formation, if the support for the image-receiving layer, as well as any other layers intermediate said support and image-receiving layer, is transparent and a processing composition containing a substance, e.g., a white pigment, effective to mask the developed silver halide emulsion or emulsions is applied between the image-receiving layer and said silver halide emulsion or emulsions.

Dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group.

The image-forming components of diffusion transfer process film units of the present invention may also incorporate dye-releasing compounds, for example dye-releasing thiazolidines, as disclosed in U.S. Pat. Nos. 3,719,489; 4,098,783 and 4,740,448.

Multicolor images may be obtained using the color image-forming components in an integral multilayer photosensitive element, such as is disclosed in the aforementioned U.S. patents and in U.S. Pat. No. 3,345,163. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, for example, a cyan dye developer, a magenta dye developer and a yellow dye developer. The dye developer may be utilized in the silver halide emulsion stratum, for example in the form of particles, or it may be disposed in a stratum (e.g., of gelatin) behind the appropriate silver halide emulsion stratum. Each set of silver halide emulsion and associated dye developer strata preferably are separated from other sets by suitable interlayers. In certain instances, it may be desirable to incorporate a yellow filter in front of the green-sensitive emulsion and such yellow filter may be incorporated in an interlayer. However, if the yellow dye developer has the appropriate spectral characteristics and is present in a state capable of functioning as a yellow filter, a separate yellow filter may be omitted.

Although the transparent layer of the present imaging medium may be formed from a variety of polymers, the preferred polymer for this purpose is a polyester, poly(ethylene terephthalate) being especially preferred. A polyester transparent layer which is biaxially oriented normally has a refractive index in excess of about 1.6, and typically around 1.64. The thickness of the transparent layer is desirably in the range of about 0.05 to about 0.2 mm.

As is well-known to those skilled in the photographic art, the surface of such a polyester transparent layer remote from the image-receiving layer is desirably provided with an anti-reflective coating which serves to reduce reflection of light entering the transparent layer, thereby allowing the image to be seen without annoying reflections of light sources superimposed thereon. Also, the surface of such a polyester transparent layer facing the image-receiving layer is desirably provided with a sub-coat which improves adhesion of the other layers of the imaging medium to the transparent layer. Polyester films intended for use in imaging media are sold commercially with the sub-coat already in place, and a specific polyester film which has been found to give good results in the present imaging medium is that sold by ICI North America, Wilmington, Del. The good results obtained using this base in the present imaging medium are somewhat surprising, since this material is primarily intended to be solvent coated, whereas the preferred low refractive index polymers used to form the image enhancement layer in the present imaging medium are preferably deposited from aqueous media.

In choosing the materials for the image-receiving layer, transparent layer and image enhancement layer, care must be taken to ensure that the materials are compatible with one another so that they adhere to each other, do not delaminate, and do not impose strains on each other sufficient to cause one layer to crack visibly, since such cracking adversely affects the quality of the image seen. If such cracking is experienced, use of a harder fluorocarbon material is recommended. It also appears that such cracking problems can be alleviated or overcome by depositing the image-receiving layer either at the same time as, or with a very short time after, the image enhancement layer is deposited, so that the image-receiving layer is deposited while the image enhancement layer is still wet.

Cracking problems may also be experienced in a gelatin permeated image-receiving layer in contact with a fluorocarbon image enhancement layer. In this case, it has been found that interposing a partially hydrolyzed poly(vinyl alcohol) tie coat between the image-receiving layer and the image enhancement layer may overcome the cracking problem, or a tie-coat of plain gelatin might be used. Alternatively, a harder fluorocarbon material may be substituted to alleviate or overcome the cracking problem.

The image-receiving, image enhancement and transparent layers of the imaging material of the present invention may be formed by conventional techniques which will be well-known to those skilled in the photographic art. Typically, a transparent film having a sub-coat on one surface is coated using automatic coating equipment, with (a) an anti-reflective coating on the surface lacking a sub-coat; (b) an aqueous latex or solution of the polymer which forms the image enhancement layer; and (c) an aqueous latex or solution of the polymer which forms the image-receiving layer. It is often desirable to include a surfactant in one or both of these solutions or latices, since the surfactant assists in producing an even coating. As previously noted, it is sometimes advantageous to deposit the image-receiving layer either at the same time as, or with a very short time after, the image enhancement layer is deposited, so that the image-receiving layer is deposited while the image enhancement layer is still wet. Also, it should be noted that some of the fluorocarbon polymers used in the image enhancement layer produce coatings so tacky that the coated material cannot be rolled up without blocking (adhesion of adjacent plies of material to one another), and in such cases obviously the image-receiving layer should be coated before the film is rolled up.

The imaging medium of the present invention provides significant improvement in image quality as compared with similar imaging media lacking the image enhancement layer; preferred embodiments of the invention can provide improvements of up to 14 units in subjective quality factor. The image enhancement layer can be formed using techniques and apparatus familiar to those skilled in preparing conventional imaging media.

Although the imaging medium of the present invention is primarily intended for use in an integral diffusion transfer process film unit, it can be used in any application in which an image is viewed through an overlying transparent layer of significant thickness. Thus, for example, the present invention could be applied in the production of photographic prints in which the image is covered by a relatively thick protective layer. The present invention may also be useful in the production of half-tone images, in which proofing of the half-tone images is sometimes rendered difficult by halo effects caused by transparent layers overlying the layer containing the half-tone image.

Furthermore, it has been found that, in at least some embodiments of the present invention, the inclusion of the image enhancement layer also improves the aging properties of the prints produced. Prints produced by conventional integral diffusion transfer process film units suffer a drop in subjective quality factor as the print ages, whereas, as illustrated in the Examples below, prints produced by at least some of the film units of the present invention display an improvement in subjective quality factor after aging.

Preferred embodiments of the invention will now be described, though by way of illustration only, to show details of preferred materials, conditions and techniques used in the present invention.

FIG. 1 of the accompanying drawings illustrates a diffusion transfer film unit of the type disclosed in the aforementioned U.S. Pat. No. 4,740,448, which is adapted to provide integral negative-positive reflection prints. This integral diffusion transfer process film unit comprises a photosensitive component or element 1 shown in superposed relationship with a transparent image-receiving ("positive") component or element 5 through which photoexposure of the photosensitive element is to be effected. A rupturable container or pod 3 releasably holding a processing composition is positioned between the photosensitive and image-receiving elements 1 and 5. The photosensitive element 1 comprises an opaque support 10 carrying, in sequence, a neutralizing layer 12 of a polymeric acid, a layer 14 adapted to time the availability of the polymeric acid by preventing diffusion of the processing composition thereto for a predetermined time, a cyan dye developer layer 16, a spacer layer 18, a red-sensitive silver halide emulsion layer 20, a spacer layer 22, a magenta dye developer layer 24, a spacer layer 26, a green-sensitive silver halide emulsion layer 28, a spacer layer 30 containing a silver ion scavenger, a yellow filter dye layer 32, a layer 34 of a yellow image dye-releasing thiazolidine, a spacer layer 36 containing a colorless silver halide developing agent, a blue-sensitive silver halide emulsion layer 38 and a top coat or anti-abrasion layer 40. All these layers are as described in the aforementioned U.S. Pat. No. 4,740,448, and consequently will not be further described herein.

The imaging-receiving element 5 comprises a transparent layer 50 (comprised of a poly(ethylene terephthalate) film) which carries on its upper surface (as illustrated in FIG. 1) an anti-reflective coating layer 52 and on its lower surface a sub-coat 54. To the lower surface of the sub-coat 54 is fixed an image enhancement layer 56 having a low refractive index. Below the image enhancement layer 56 are disposed an image-receiving layer 58 and a decolorizing layer or clearing coat 60. Apart from the image enhancement layer 56, the layers of the image-receiving element 5 are the same as those described in the aforementioned U.S. Pat. No. 4,740,448.

As indicated by the arrow in FIG. 1, photoexposure of the silver halide layers in the photosensitive element 1 is effected through the image-receiving element 5, all the layers 50–60 in the image-receiving element 50 being made transparent to permit such exposure, and the film unit being so positioned within the camera that light admitted through the camera exposure or lens system is incident upon the outer or exposure surface of the transparent support 50. After exposure, the film unit is advanced between suitable pressure-applying members, rupturing the pod 3, thereby releasing and distributing a layer of an opaque processing composition containing titanium dioxide and pH-sensitive optical filter agents or dyes as taught in U.S. Pat. No. 3,647,347, and forming a laminate of the photosensitive element 1 and the image-receiving element 5. The processing composition is initially opaque, having an initial pH at which the optical filter agents contained therein are colored: the optical filter agent (agents) is (are) selected to exhibit the appropriate light absorption over the wavelength range of light actinic to the particular silver halide emulsion(s) in the photosensitive element 1. As a result, ambient or environmental light within that wavelength range passing through the image-receiving element 5 is absorbed by the processing composition, thereby avoiding further exposure of the photoexposed and developing silver halide emulsion(s). Immediately after the spreading of the processing composition, the portion thereof immediately adjacent the clearing coat 60 is decolorized by that layer, for the reasons explained in the aforementioned U.S. Pat. No. 4,367,277.

Exposed blue-sensitive silver halide in layer 38 is developed by a colorless silver halide developing agent initially present in spacer layer 36. Unexposed blue-sensitive silver halide is dissolved by a silver solvent initially present in the processing composition and transferred to layer 34 containing a yellow image dye-releasing thiazolidine. Reaction with the complexed silver initiates a cleavage of the thiazolidine ring and release of a diffusible yellow image dye, as described, for example, in the U.S. Pat. Nos. 3,719,489 and 4,098,783.

Development of the exposed green-sensitive and red-sensitive silver halide in layers 28 and 20 respectively results in the imagewise immobilization of the magenta and cyan dye developers, respectively. Unoxidized magenta and cyan dye developers in unexposed areas of the green- and red-sensitive silver halide emulsions remain diffusible and transfer to the image-receiving layer 58 through the developed blue-sensitive silver halide emulsion layer 38. Transfer of the imagewise released yellow image dye and the imagewise unoxidized magenta and cyan dye developers to the image-receiving layer 58 is effective to provide the desired multicolor transfer image.

Permeation of the alkaline processing composition through the timing layer 14 to the polymeric acid layer 12 is so controlled that the process pH is maintained at a high enough level to effect the requisite development and image transfer and to retain the optical filter agents in colored form within the processing composition layer and on the silver halide emulsion side of this layer, after which pH reduction effected as a result of alkali permeation into the polymeric acid layer 12 is effective to reduce the pH to a level which changes the optical filter agents to a colorless form. Absorption of water from the applied layer of the processing composition results in a solidified film composed of the film-forming polymer and the white pigment dispersed therein, thus providing a light-reflecting layer which also serves to laminate together the photosensitive component 1 and the image-receiving component 5 to provide the final integral image. The positive transfer image present in the image-receiving layer 58 is viewed in the direction of the arrow in FIG. 1, through the transparent layer 50 and its associated layers 52 and 54, through the image enhancement layer 56 and with the light-reflecting layer formed from the processing composition acting as a diffuse reflector behind the image. The light-reflecting layer also effectively masks from view the developed silver halide emulsion and dye developer immobilized therein or remaining in the dye developer layer in the photosensitive element 1.

Figure 2B:
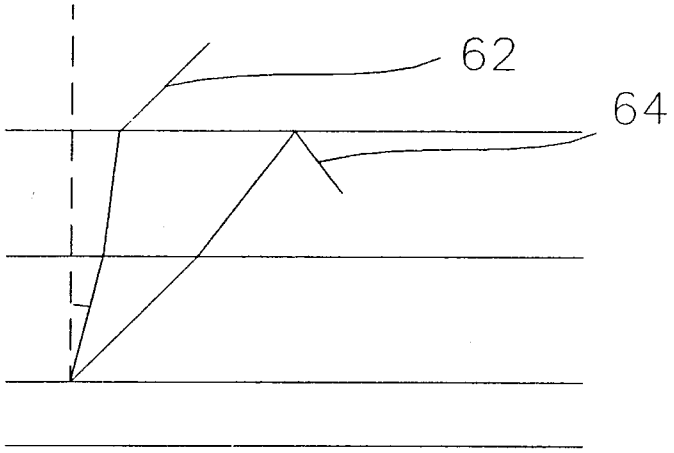
FIG. 2B is a ray diagram similar to FIG. 2A for a prior art image-receiving element which lacks the image enhancement layer shown in FIGS. 1 and 2A.
Figure 2A:
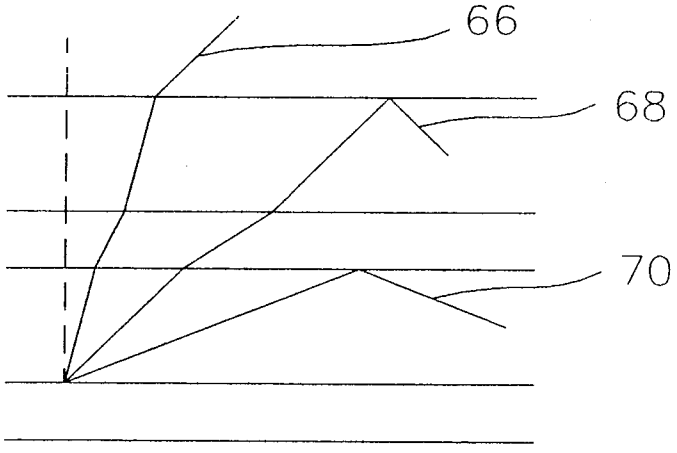
FIG. 2A shows the paths of various rays travelling through the image-receiving element of the film unit shown in FIG. 1 as it is viewed by an observer.

The effects on the quality of the image perceived by a viewer of internal reflections within the image-receiving element 5 will now be considered with reference to FIG. 2A, which shows the paths of various rays passing through the image-receiving element 5. FIG. 2B shows a diagram similar to FIG. 2A for a prior art image-receiving element which lacks the image enhancement layer 56, but is otherwise identical to that shown in FIG. 2A. To simplify the explanation, the anti-reflective coating layer 52 and the sub-coat 54 are omitted from FIGS. 2A and 2B; it can be shown that, because of their thinness, in practice these two layers have very little effect on the conclusions reached from the simplified model shown in FIG. 2A.

Consider first the simpler situation in FIG. 2B, where the image-receiving element comprises only a transparent layer and an image-receiving layer. FIG. 2B also shows the light-reflecting layer derived from the processing composition (FIG. 1). Light is diffusely reflected from the light-reflecting layer, and passes through the image-receiving layer and the transparent layer. At the transparent layer/air boundary, rays such as ray 62, which have an angle of incidence on this boundary less than $\Theta_c$, the critical angle, will pass through the boundary and be seen directly by the viewer. On the other hand, rays such as ray 64, which have an angle of incidence greater than $\Theta_c$, will undergo internal reflection and will return through the transparent layer to the image-receiving layer.

$\Theta_c$ is given by:

$$\sin \Theta_c = 1 n_T$$

where $n_T$ is the refractive index of the transparent layer. Applying Snell's Law to the boundary between the transparent layer and the image-receiving layer, it will be seen that a ray which has angle of incidence $\Theta_c$ on the transparent layer/air boundary has an angle of incidence $\Theta_i$ on the transparent layer/image-receiving layer boundary given by:

$$\sin \Theta_i 1/n_I$$

where $n_I$ is the refractive index of the image-receiving layer.

Since the light reflected from the light-reflecting layer into the image-receiving layer may be assumed to be uniformly distributed, and since the solid angle within angle $\Theta$ of the perpendicular to the light-reflecting layer is proportion to $\sin^2 \Theta$, the fraction, F, of light reflected from the light-reflecting layer which emerges from the transparent layer is given by:

$$F=(1/n_I)^2$$

For an image-receiving layer with a refractive index of 1.6, F is 0.391.

If the one-pass reflection of the image-receiving element is R (this being the fraction of light incident on the surface of the transparent layer which survives two passages through the transparent layer and the dye in the image-receiving layer at some average angle), the proportion of light originally incident on the transparent layer which emerges after one reflection from the light-reflecting layer is FR. Furthermore, since the fraction (1-F) of light which undergoes internal reflection at the transparent layer/air boundary after its first reflection travels back to the light-reflecting layer and may be assumed to again be diffusely reflected from that layer, the fraction of the originally incident light emerging after two passes through the image-receiving element is FR(1-F)R, after three passes $FR(1\text{-}F)^2R^2$, etc. The sum of the resulting infinite series:

$$FR(1+(1-F)R+(1-F)^2R^2+(1-F)^3R^3+\ldots$$
$$=FR/(1-R+FR).$$

Thus, FR of the originally incident light emerges after one pass through the image-receiving element, while a total of $FR/(1-R+FR)$ emerges after one or more passes. Accordingly, the apparent reflectance density, D, of the image is given by:

$$D=-\log(FR/[1-R+FR),$$

and the proportion, T, of the emerging light which has undergone only one passage through the element is given by:

$$T=1-R+FR.$$

Figure 3:
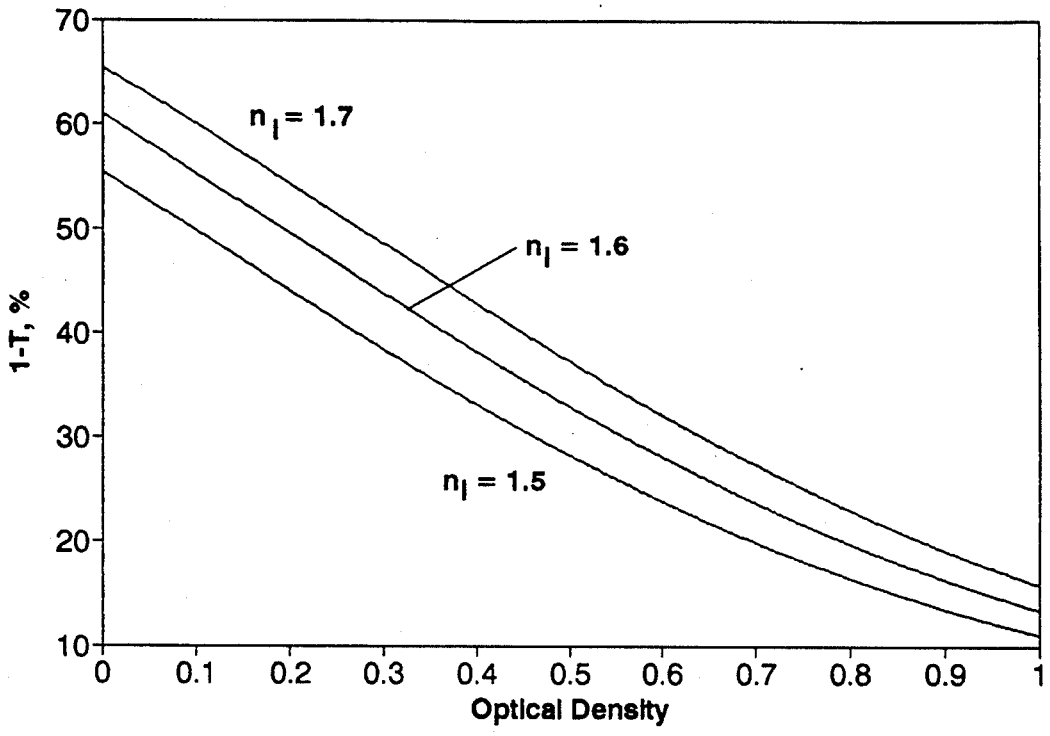
FIG. 3 is a graph showing the proportion of light emerging from the image-receiving element of FIG. 2B which has undergone more than one passage through the element, as a function of the apparent optical density of the image and the refractive index of the transparent layer.

FIG. 3 of the accompanying drawings shows the proportion $(1-T)$ of light which emerges after more than one pass, for transparent layer refractive indices of 1.5, 1.6 and 1.7, over a range of optical densities of 0 to 1.0. From this Figure, it will be seen that the proportion of emerging light which has undergone more than one pass through the image-receiving element (hereinafter referred to as "the multi-pass light") is greater at low optical densities (i.e., at highlights of the image) and increases with increasing refractive index of the transparent layer.

The multi-pass light has undergone multiple passes through the dye layer at points displaced from one another by 2t tan $\Theta$, there t is the thickness of the transparent layer (in view of the thinness of the image-receiving layer relative to the transparent layer, the displacements due to the image-receiving layer can be ignored, in a first approximation). These multiple passes through the dye layer at spaced points may contribute to the apparent diffusion of color which can be detected by close visual observation of prints produced from integral diffusion transfer process film units. FIG. 3 confirms visual observations that this diffusion effect is greater in low optical density regions of the image.

In the imaging-receiving element of the present invention shown in FIG. 2A, at the transparent layer/air boundary, rays such as ray 66, which have an angle of incidence on this boundary less than $\Theta_c$, the critical angle, will pass through the boundary and be seen directly by the viewer, in the same manner as ray 62 in FIG. 2B. As explained above, such rays have angles of incidence within the image-receiving layer not greater than $\Theta_i$, where $\Theta_i$ is given by:

$$\sin \Theta_i = 1/n_I$$

where $n_I$ is the refractive index of the image-receiving layer. Rays such as ray 68, which have an angle of incidence within the image-receiving layer somewhat greater than $\Theta_i$ will pass through the image enhancement layer and undergo internal reflection at the transparent layer/air boundary, in a manner similar to ray 64 in FIG. 2B. However, rays such as ray 70 in FIG. 2A, which have angles of incidence at the image-receiving layer/image enhancement layer boundary greater than $\Theta_e$, where $\Theta_e$ is given by:

$$\sin \Theta_e = n_E/n_I$$

where $n_E$ is the refractive index of the image enhancement layer, will undergo internal reflection at the image-receiving layer/image enhancement layer boundary.

Accordingly, again assuming completely diffuse reflection by the light-reflecting layer, the relative proportions of the incident light which follow the three types of paths illustrated in FIG. 2A are as follows:

Ray 66 (emergence after a single pass): $F=(1/n_I)^2$ for exactly the same reasons as in FIG. 2B Ray 68 (internal reflection at top of transparent layer): $(n_E/n_I)^2-(1/n_I)^2$ Ray 70 (internal reflection from bottom of image enhancement layer): $1-(n_E/n_I)^2$.

Because of the thinness of the image-receiving layer relative to that of the transparent layer (the relative thickness of the transparent layer is greatly reduced in the drawings for ease of illustration), rays such as ray 70 will contact the light-reflecting layer for a second time very close to their original point of contact, so that the blurring effect of such light on the image seen by a viewer will be very small and can be ignored in a first approximation; the blurring can be considered to result only from the rays which effect more than one round trip through the transparent layer. Furthermore, since the losses due to absorption within the transparent layer and the image-receiving layer are small compared to the losses in the dye and on reflection by the light-reflective layer, both rays 68 and 70 will suffer the same attenuation between the time of their internal reflection and their second contact with the light-reflective layer.

The actual effect of the image enhancement layer in improving perceived image quality is, however, greater than might by expected simply from the fractions of light following the paths shown in FIG. 2B. As already noted, the multi-pass light has undergone multiple passes through the dye layer at points displaced from one another by 2 t tan Θ, there t is the thickness of the transparent layer, and these multiple passes through the dye layer at spaced points are responsible for the apparent diffusion of color in the print. Because the lateral displacement is proportional to tan Θ, rays at high Θ (greater than, say, 60°) contribute disproportionately to blurring of the image, and it is precisely these high Θ rays which undergo internal reflection at the image-receiving layer/image enhancement layer boundary in the imaging medium of the present invention.

Figure 4:
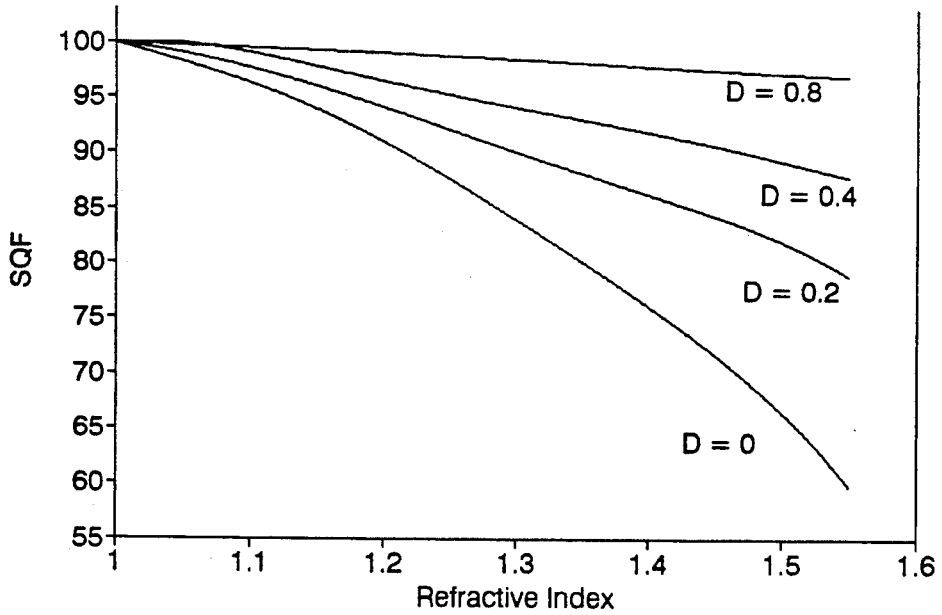
FIG. 4 is a graph of Granger Subjective Quality Factor against the refractive index of the image enhancement layer for various local densities for the image-receiving element shown in FIGS. 1 and 2A.

FIG. 4 is a graph of the computed Granger subjective quality factor (the integral of the modulation transfer function over the range 0.5–2.0 $mm^{-1}$; see Granger and Cupery, "An optical merit function (SQF), which correlates with subjective image judgments", Photographic Science and Engineering 16(3), 221 (1972)) against the refractive index of the image enhancement layer for various local optical densities, for the image-receiving element shown in FIG. 2A, assuming a transparent layer thickness of 0.003 inch (approximately 0.076 mm.). As would be expected, at any given refractive index of the image enhancement layer, the improvement in subjective quality factor increases sharply at low optical densities.

Figure 5:
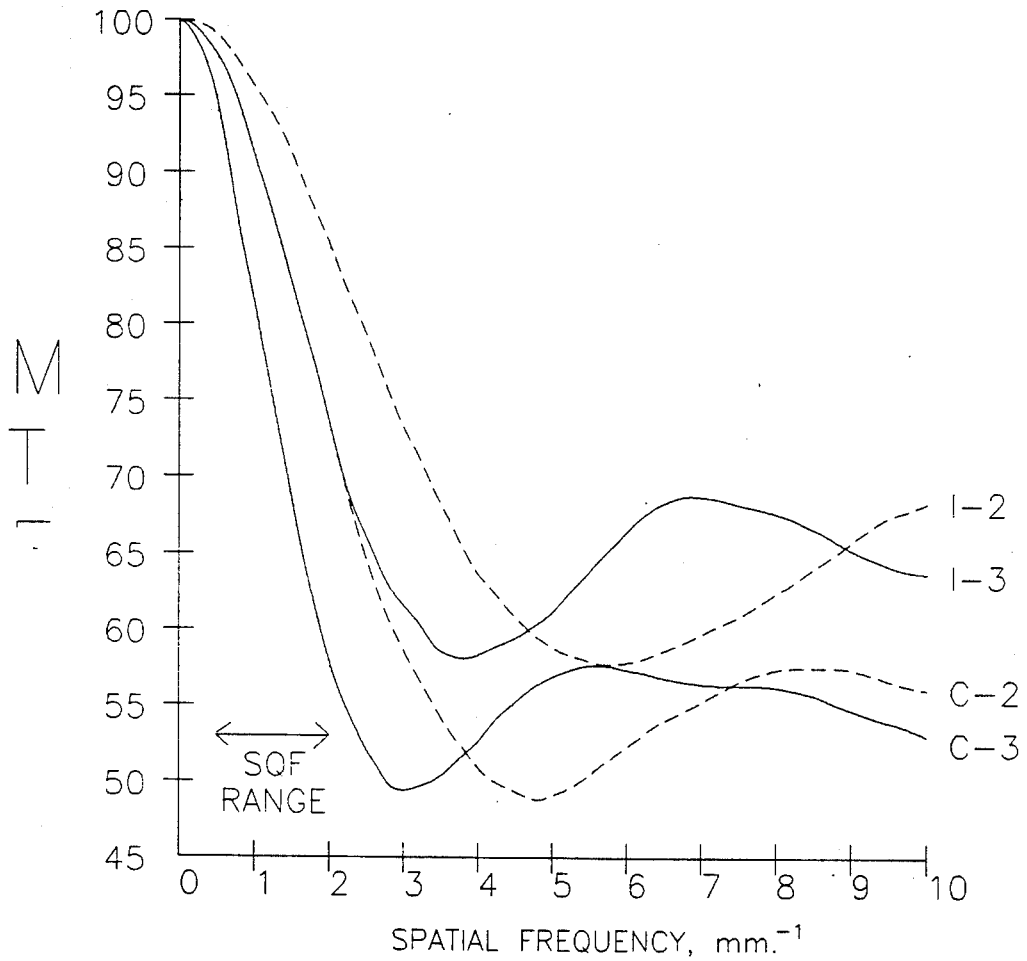
FIG. 5 is a graph of modulation transfer function against frequency for the image-receiving elements shown in FIGS. 2A and 2B.

FIG. 5 is a graph of calculated modulation transfer function against frequency at an optical density of 0.204 for prints from a diffusion transfer film unit having a transparent layer having a refractive index of 1.55 and either 0.002 or 0.003 inches (0.051 or 0.076 mm.) thick, as compared with corresponding film units of the present invention having the same transparent layer but also having an image enhancement layer with a refractive index of 1.33. The control units with transparent layers 0.002 and 0.003 inches thick are designated C-2 and C-3 respectively in FIG. 5, while the units of the present invention are similarly designated I-2 and I-3. "SQF RANGE" indicates the Granger subjective quality factor frequency range of 0.5–2.0 $mm^{-1}$. It will be seen that in both cases the presence of the image enhancement layer causes a substantial increase in subjective quality factor; the calculated subjective quality factors are:

| Film Unit | Subective Ouality Factor |
|---|---|
| C-2 | 0.888 |
| C-3 | 0.797 |
| I-2 | 0.943 |
| I-3 | 0.887 |

Figure 6:
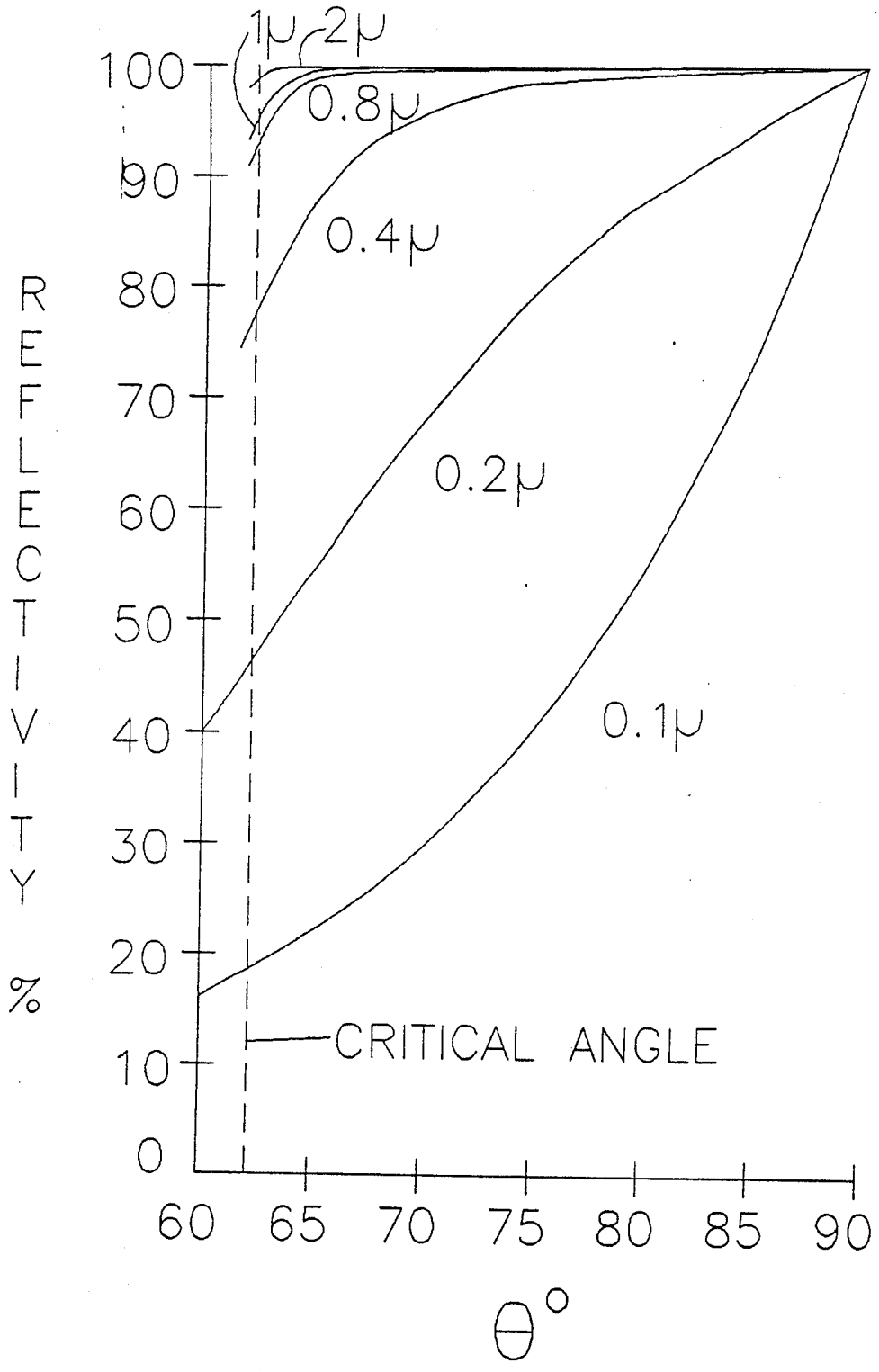
FIG. 6 is a graph showing the variation of reflectivity of an image enhancement layer with thickness of that layer and angle of incidence of light upon the image enhancement layer/image-receiving layer boundary, in an imaging medium of the present invention.

FIG. 6 is a graph showing the variation in reflectivity, over the range of 60°–90°, of an image enhancement layer of refractive index 1.37 used in the image-receiving element of FIG. 2A with an image-receiving layer having a refractive index of 1.55 and a transparent layer having a refractive index of 1.65, with thickness of the image enhancement layer, for light of wavelength 0.55 μ, as calculated from the equation:

$$R = \frac{e^{2b} + e^{-2b} + 2\cos(\phi_{12} - \phi_{23})}{e^{2b} + e^{-2b} + 2\cos(\phi_{12} + \phi_{23})}$$

where R is the overall reflectivity;

$$b = \frac{2\pi n_2 h\cos\theta_2}{\lambda_0} = \frac{2\pi h\sqrt{n_1^2\sin^2\theta_1 - n_2^2}}{\lambda_0}$$

and $\phi_{12}$ and $\phi_{23}$ are given by:

$$r_{12} = e^{i\phi_{12}} = \frac{n_1\cos\theta_1 - i\sqrt{n_1^2\sin^2\theta_1 - n_2^2}}{n_1\cos\theta_1 + i\sqrt{n_1^2\sin^2\theta_1 - n_2^2}}$$

$$r_{23} = e^{i\phi_{23}} = \frac{i\sqrt{n_1^2\sin^2\theta_1 - n_2^2} - n_3\cos\theta_3}{i\sqrt{n_1^2\sin^2\theta_1 - n_2^2} + n_3\cos\theta_3}$$

where $r_{12}$ and $R_{23}$ are the reflectivities at the interfaces between the first and second, and second and third layers respectively, $n_1$, $n_2$ and $n_3$ are the refractive indices of the three layers, $\Theta_1$ and $\Theta_3$ are the angles of incidence in the first and third layers respectively, h is the thickness of the central, image enhancement layer, and $\lambda_0$ is the wavelength of the light in vacuum. (See, for example, Born and Wolff, Principles of Optics, 6th edn. (1975), pages 65 and 66.)

From FIG. 6, it will be seen that 80% reflectivity at the critical angle of about 62° is achieved at a thickness of about 0.5 μ, and 0.8 μ thickness yields a reflectivity of about 93% at the same angle. Thus, increases in thickness of the image enhancement layer above about 0.8 μ would not be expected to yield any further significant improvement in image quality.

EXAMPLE 1

This Example illustrates the preparation and use of a preferred film unit of the present invention.

An integral diffusion transfer process film unit as shown in FIG. 1 and 2A was prepared from the following materials:

Transparent support 50 and sub-coat 54: Sub-coated poly(ethylene terephthalate) film purchased from ICI North America, Wilmington, Del., refractive index 1.64;

Anti-reflective coating 52: A quarter-wavelength coating of a fluorinated polymer blend, refractive index 1.42;

Image enhancement layer 56: Fluorel FC-2175, coated from a 7.5% solution in 2-pentanone at 300 mg/ft$^2$. The layer had a refractive index of 1.370;

Image-receiving layer 58: As described in the aforementioned U.S. Pat. No. 4,794,067, and comprising a mixture of a quaternary ammonium copolymeric mordant of the first of the two formulae given above in which $R^1$, $R^2$, $R^3$, $R^4$ and $R^5$ are all methyl groups and $R^6$ is a dodecyl group, with poly(vinyl alcohol). The layer was coated at 300 mg/ft$^2$, and had a refractive index of 1.55;

The pod 3 and the photosensitive element 1 of the film unit were as described in the aforementioned U.S. Pat. No. 4,740,448.

To provide a control, an exactly similar film unit was prepared, except that the image enhancement layer was omitted.

To determine the subjective quality factors of prints produced from the two film units, both units were tested using a standard subjective quality factor test in which a line edge is photographed, and the resultant image is scanned by an optical densitometer and the subjective quality factor calculated.

Figure 7:
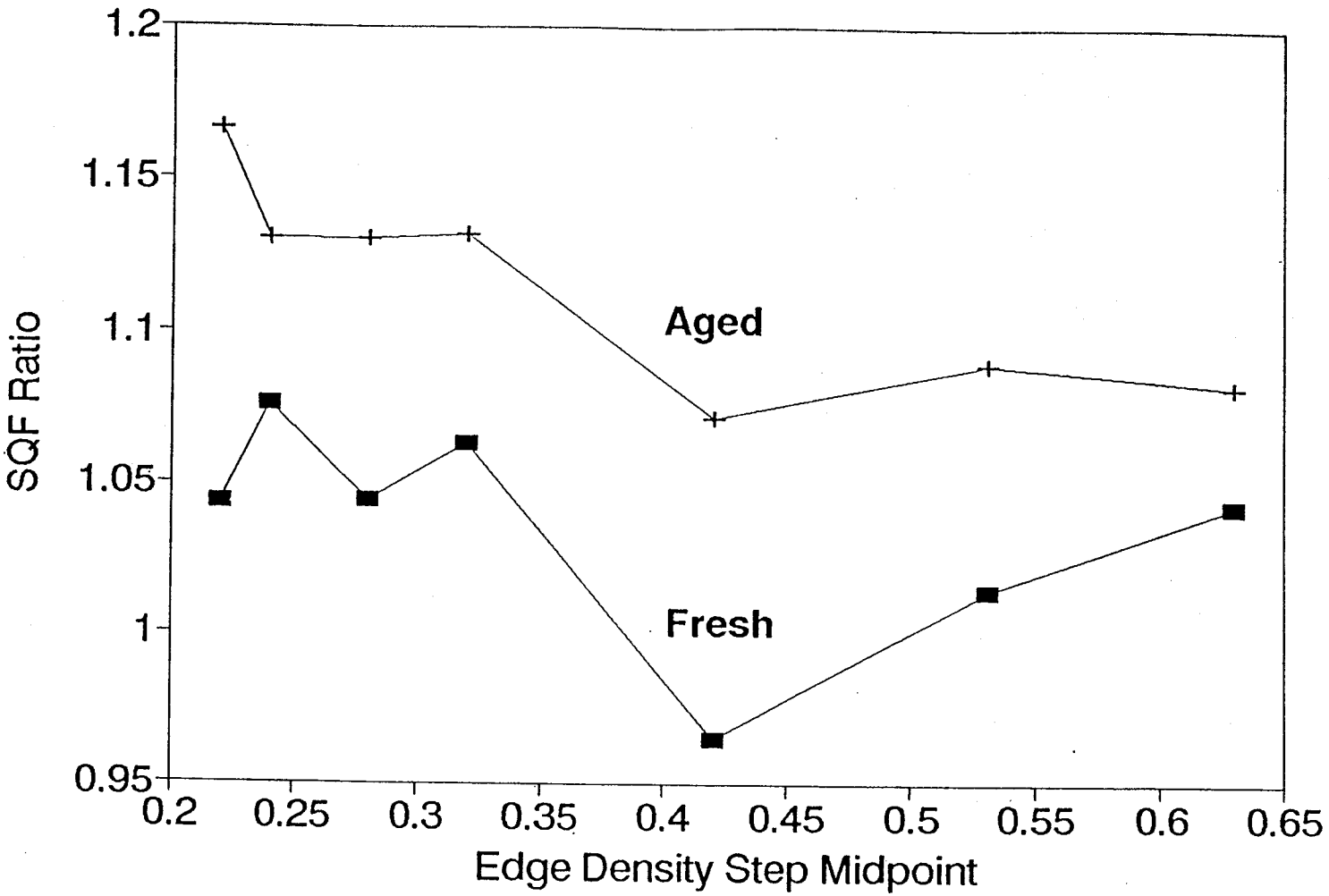
FIG. 7 is a graph of the ratios, at various mean edge step densities, between the subjective quality factors of a print made on an imaging medium of the present invention, as compared with that of a similar print made using a conventional imaging medium, both before and after aging, as described in Example 1 below.

The ratios between the subjective quality factors of the film unit of the present invention and the control film unit at various optical densities are shown in FIG. 7 for both fresh prints and prints which had been subjected to an accelerated aging test of 6 days storage at 120° F. (49° C.); empirically, for diffusion transfer film units this aging test has been found to be equivalent to several months storage at room temperature. As may be seen from FIG. 7, incorporation of the image enhancement layer produced a maximum improvement of about 15 percent, and an average improvement of about 12 percent, in the subjective quality factor of the film unit.

From FIG. 7, it will be seen that the improvement in subjective quality factor produced by the present invention was substantially greater after aging. Although the reasons for this greater improvement in subjective quality factor after aging properties are not entirely understood, and this invention is in no way restricted to any theoretical explanation of this phenomenon, it is believed that the difference in aging properties is related to the increase in refractive index of the image-receiving layer which takes place as a print from this type of film unit ages. During the development process, the image-receiving layer absorbs moisture from the processing composition and swells, with consequent lowering of its refractive index. As the print ages, moisture is gradually lost from the image-receiving layer by diffusion, and the image-receiving layer shrinks, with consequent increase in its refractive index. From the analysis given above of the optical properties of the conventional image-receiving element shown in FIG. 2B, it will be seen that the proportion of light which emerges from the element after only a single pass is proportional to $(1/n_I)^2$, where $n_I$ is the refractive index of the image-receiving layer. Consequently, as this refractive index increases, the proportion of light emerging after only a single pass through the element decreases, and the subjective quality factor falls.

In an image-receiving element of the present invention, the same decrease in the proportion of light emerging after only a single pass through the element occurs. However, assuming that the refractive index of the image enhancement layer remains unchanged during aging, or at least that the change in this refractive index during aging is proportionately less than that of the image-receiving layer, the decrease in the proportion of light emerging after only a single pass is accompanied by an increase in the proportion of light which undergoes internal reflection at the image enhancement layer-/image-receiving layer boundary, since the parameter $n_E/n_I$ decreases. The net effect of both changes is to reduce the decrease in subjective quality factor suffered during aging of the print.

This theory does not explain a statistically-significant increase in subjective quality factor of the film unit of the present invention found in these experiments; for example, at a density of 0.22, the subjective quality factor of the film unit of the invention increased from 71.8% when fresh to 76.4% after aging. This increase may be due to slow migration of additional dyes from the photosensitive element to the image-receiving layer during aging of the print. Although a similar migration of dye occurs in the control film unit, the effect of this migration in increasing subjective quality factor is apparently masked by the much greater decrease caused by the increase in refractive index of the image-receiving layer.

EXAMPLE 2

Example 1 was repeated, except that in the film unit of the present invention, the image enhancement layer was formed from Fluorel FC-2178, coated from a 7.5% solution in 2-pentanone at a coating weight of 300 mg/ft$^2$ to produce a layer having a refractive index of 1.370.

Figure 8:
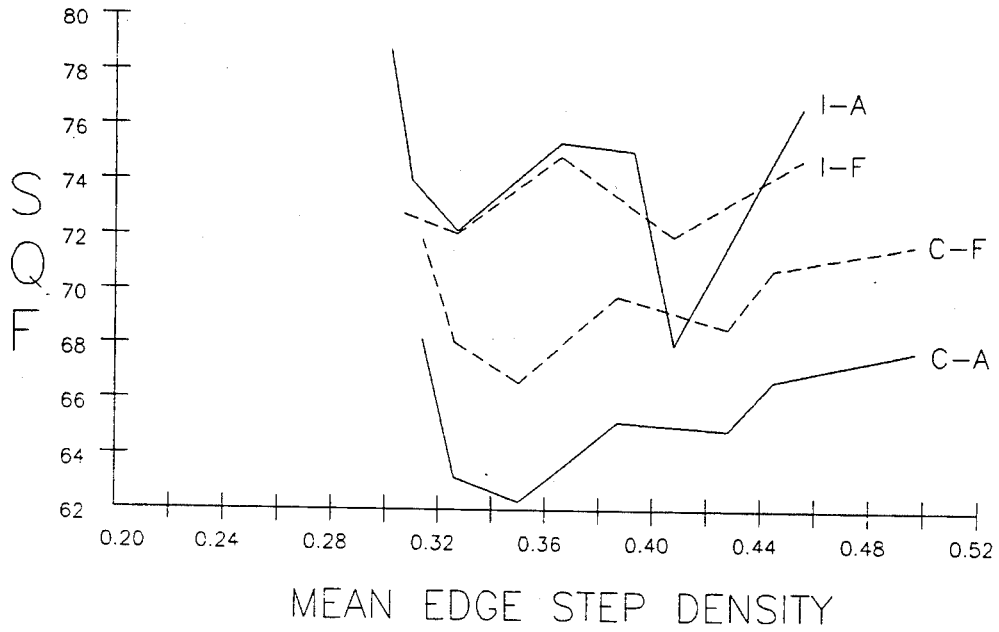
FIG. 8 is a graph of the subjective quality factors against mean edge step densities of prints made on an imaging medium of the present invention, and a similar print made using a conventional imaging medium, both before and after aging, as described in Example 2 below.

In FIG. 8, the subjective quality factor values obtained are plotted against the mean edge step density of the target. Curve I-F is that obtained from fresh prints using the film unit of the invention, curve I-A that obtained from the same unit after aging, curve C-F that obtained from fresh prints using the control film unit, and curve C-A that obtained from the same unit after aging.

It will be seen the results obtained from these experiments are similar to those obtained in Example 1 above. In both the fresh and the aged prints, the film unit of the present invention shows a subjective quality factor substantially greater than that of the control film unit. However, the improvement in subjective quality factor is much greater after aging, because the control film unit undergoes a substantial loss of subjective quality factor on aging, whereas the film unit of the present invention shows a slight improvement in subjective quality factor after aging.

EXAMPLE 3

Example 1 was repeated except that in the film unit of the present invention, the image enhancement layer was formed from a terpolymer of vinylidene fluoride, hexafluoropropylene and tetrafluoroethylene, coated from solution in 2-pentanone at a coating weight of 300 mg/ft$^2$ to produce a layer having a refractive index of 1.385.

Figure 9:
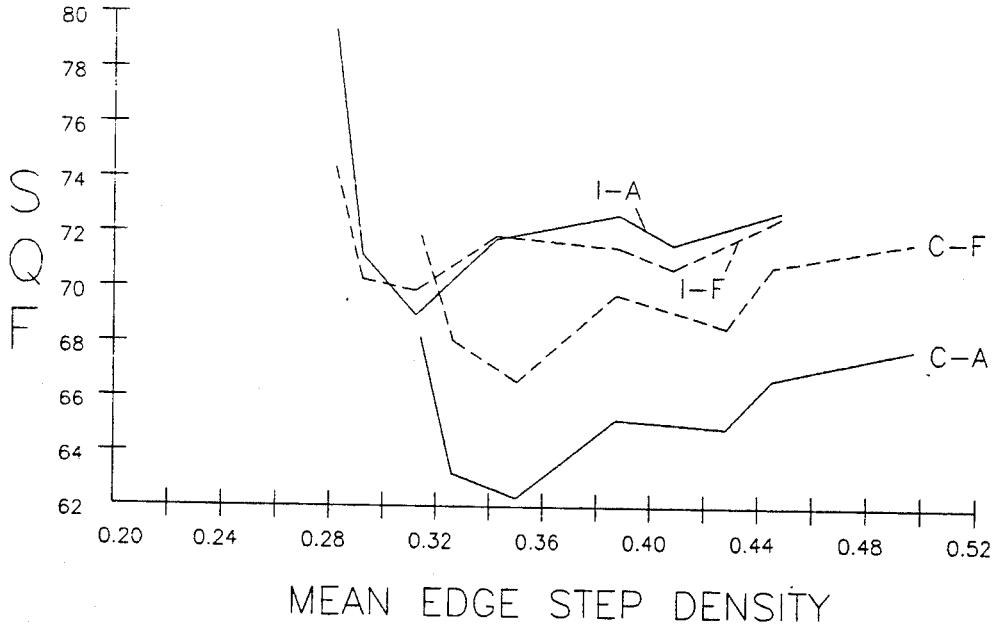
FIG. 9 is a graph similar to FIG. 8 but showing the results obtained in Example 3 below.

In FIG. 9, the subjective quality factor values obtained are plotted against the mean edge step density of the target. Curve I-F is that obtained from fresh prints using the film unit of the invention, curve I-A that obtained from the same unit after aging, curve C-F that obtained from fresh prints using the control film unit, and curve C-A that obtained from the same unit after aging.

It will again be seen the results obtained from these experiments are similar to those obtained in Example 1 above. In both the fresh and the aged prints, the film unit of the present invention shows a subjective quality factor substantially greater than that of the control film unit. However, the improvement in subjective quality factor is much greater after aging, because the control film unit undergoes a substantial loss of subjective quality factor on aging, whereas the film unit of the present invention shows a slight improvement in subjective quality factor after aging.

We claim:

1. An imaging medium comprising:
means for providing a light-reflecting layer;
an image-receiving layer for receiving image-forming components;
a transparent layer superposed over the image-receiving layer on the opposed side thereof from the means for providing a light-reflecting layer such that an image in the image-receiving layer can be viewed through the transparent layer against the light-reflecting layer provided by said means; and
an image enhancement layer disposed between the image-receiving layer and the transparent layer, the image enhancement layer having a refractive index less than the refractive indices of the image-receiving layer and the transparent layer, and not greater than about 1.43.

2. A medium according to claim 1 wherein the refractive index of the image enhancement layer is not greater than about 1.40.

3. A medium according to claim 2 wherein the refractive index of the image enhancement layer is not greater than about 1.38.

4. A medium according to claim 3 wherein the refractive index of the image enhancement layer is in the range of from about 1.29 to about 1.38.

5. A medium according to claim I wherein the image enhancement layer comprises a fluoroolefin polymer.

6. A medium according to claim 5 wherein the image enhancement layer comprises a copolymer of vinylidene fluoride and hexafluoropropylene, a terpolymer of vinylidene fluoride, hexafluoropropylene and tetrafluoroethylene, or a blend of such a copolymer or terpolymer with polytetrafluoroethylene.

7. A medium according to claim 1 wherein the image enhancement layer has a thickness in the range of about 0.5 to 5 $\mu$.

8. A medium according to claim 7 wherein the image enhancement layer has a thickness in the range of about 0.8 to about 2 $\mu$.

9. A medium according to claim I wherein the image-receiving layer has a refractive index in the range of about 1.5 to about 1.6 and the transparent layer has a refractive index greater than about 1.60.

10. An imaging medium according to 1 wherein the image-receiving layer includes an image.

11. An imaging medium comprising:
means for providing a light-reflecting layer;
an image-receiving layer for receiving image-forming components, the image-receiving layer having a refractive index of at least about 1.45
a transparent layer superposed over the image-receiving layer on the opposed side thereof from the means for providing a light-reflecting layer such that an image in the image-receiving layer can be viewed through the transparent layer against the light-reflecting layer provided by said means, the transparent layer having a refractive index of at least about 1.50; and
an image enhancement layer disposed between the image-receiving layer and the transparent layer, the image enhancement layer having a refractive index not greater than about 1.43.

12. A medium according to claim 11 wherein the refractive index of the image enhancement layer is in the range of from about 1.29 to about 1.38.

13. A medium according to claim 11 wherein the image enhancement layer comprises a copolymer of vinylidene fluoride and hexafluoropropylene, a terpolymer of vinylidene fluoride, hexafluoropropylene and tetrafluoroethylene, or a blend of such a copolymer or terpolymer with polytetrafluoroethylene.

14. A medium according to claim 11 wherein the image enhancement layer has a thickness in the range of about 0.8 to about 2 $\mu$.

15. A diffusion transfer process film unit comprising first and second sheet-like elements and a rupturable pod of processing composition, the film unit having means for providing a light-reflecting layer;
the first sheet-like element comprising photosensitive and image-forming components;
the rupturable pod of processing composition being positioned to release the processing composition across the film unit between the first and second sheet-like elements and in contact with the photosensitive and image-forming components upon rupture of the pod, thereby releasing image-forming components from the first sheet-like element;
the second sheet-like element comprising an image-receiving layer for receiving image-forming components; a transparent layer superposed over the image-receiving layer on the opposed side thereof from the means for providing a light-reflecting layer such that an image in the image-receiving layer can be viewed through the transparent layer against the light-reflecting layer provided by said means; and
an image enhancement layer disposed between the image-receiving layer and the transparent layer, the image enhancement layer having a refractive index less than the refractive indices of the image-receiving layer and the transparent layer, and not greater than about 1.43.

16. A medium according to claim 15 wherein the refractive index of the image enhancement layer is not greater than about 1.40.

17. A medium according to claim 16 wherein the refractive index of the image enhancement layer is not greater than about 1.38.

18. A medium according to claim 17 wherein the refractive index of the image enhancement layer is in the range of from about 1.29 to about 1.38.

19. A medium according to claim 15 wherein the image enhancement layer comprises a fluoroolefin polymer.

20. A medium according to claim 19 wherein the image enhancement layer comprises a copolymer of vinylidene fluoride and hexafluoropropylene, a terpolymer of vinylidene fluoride, hexafluoropropylene and tetrafluoroethylene, or a blend of such a copolymer or terpolymer with polytetrafluoroethylene.

21. A medium according to claim 15 wherein the image enhancement layer has a thickness in the range of about 0.5 to 5 $\mu$.

22. A medium according to claim 21 wherein the image enhancement layer has a thickness in the range of about 0.8 to about 2 $\mu$.

23. A medium according to claim 15 wherein the image-receiving layer has a refractive index in the range of about 1.5 to about 1.6 and the transparent layer has a refractive index greater than about 1.60.

24. An imaging medium according to claim 15 wherein the image-receiving layer comprises an image.

25. An imaging medium according to claim 15 wherein the means for providing a light-reflecting layer comprises light scattering pigments in the processing composition such that, after rupture of the pod and development of the image on the image-receiving layer, the light scattering pigments provide a diffuse reflector against which the image can be viewed through the transparent layer.

26. A diffusion transfer process film unit comprising first and second sheet-like elements and a rupturable pod of processing composition, the film unit having means for providing a light-reflecting layer;

the first sheet-like element comprising photosensitive and image-forming components;

the rupturable pod of processing composition being positioned to release the processing composition across the film unit between the first and second sheet-like elements and in contact with the photosensitive and image-forming components upon rupture of the pod, thereby releasing image-forming components from the first sheet-like element;

the second sheet-like element comprising an image-receiving layer for receiving image-forming components released from the first sheet-like element, the image-receiving layer having a refractive index of at least about 1.45; a transparent layer superposed over the image-receiving layer on the opposed side thereof from the means for providing a light-reflecting layer such that an image in the image-receiving layer can be viewed through the transparent layer against the light-reflecting layer provided by said means, the transparent layer having a refractive index of at least about 1.50; and an image enhancement layer disposed between the image-receiving layer and the transparent layer, the image enhancement layer having a refractive index not greater than about 1.43.

27. A medium according to claim 26 wherein the refractive index of the image enhancement layer is in the range of from about 1.29 to about 1.38.

28. A medium according to claim 26 wherein the image enhancement layer comprises a copolymer of vinylidene fluoride and hexafluoropropylene, a terpolymer of vinylidene fluoride, hexafluoropropylene and tetrafluoroethylene, or a blend of such a copolymer or terpolymer with polytetrafluoroethylene.

29. A medium according to claim 26 wherein the image enhancement layer has a thickness in the range of about 0.8 to about 2 $\mu$.

* * * * *